US009745823B2

(12) United States Patent
Wood et al.

(10) Patent No.: US 9,745,823 B2
(45) Date of Patent: Aug. 29, 2017

(54) DOWNHOLE COMMUNICATION AND CONTROL SYSTEM AND METHOD FOR NON-SEQUENTIAL DOWNHOLE OPERATIONS

(71) Applicants: Edward T. Wood, Kingwood, TX (US); Aubrey C. Mills, Magnolia, TX (US)

(72) Inventors: Edward T. Wood, Kingwood, TX (US); Aubrey C. Mills, Magnolia, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/879,516

(22) Filed: Oct. 9, 2015

(65) Prior Publication Data

US 2016/0032683 A1 Feb. 4, 2016

Related U.S. Application Data

(62) Division of application No. 14/258,484, filed on Apr. 22, 2014, now Pat. No. 9,404,340.
(Continued)

(51) Int. Cl.
*E21B 43/26* (2006.01)
*E21B 34/14* (2006.01)
(Continued)

(52) U.S. Cl.
CPC ..... *E21B 34/066* (2013.01); *E21B 33/124* (2013.01); *E21B 34/12* (2013.01);
(Continued)

(58) Field of Classification Search
CPC .... E21B 43/26; E21B 2034/007; E21B 34/14; E21B 43/14; E21B 34/12
See application file for complete search history.

(56) References Cited

U.S. PATENT DOCUMENTS 4,928,772 A * 5/1990 Hopmann ..... E21B 34/14 166/332.1
7,337,850 B2 3/2008 Contant
(Continued)

FOREIGN PATENT DOCUMENTS

WO 2013009458 A2 1/2013

OTHER PUBLICATIONS

Petrowell® product reference RFID Operated Frac Sleeve 63-RF-50 brochure. 2010.*
(Continued)

*Primary Examiner* — Zakiya W Bates
(74) *Attorney, Agent, or Firm* — Cantor Colburn LLP

(57) ABSTRACT

A downhole communication and control system configured for use in a non-sequential order of treating a borehole, the system includes a string having at least three ports including first, second, and third longitudinally spaced ports arranged sequentially in a downhole to uphole manner in the string; at least three frac sleeve systems including first, second, and third frac sleeve systems arranged sequentially in a downhole to uphole manner in the string and arranged to open and close the first, second, and third ports, respectively, each frac sleeve system having self-powered, electronically triggered first and second sleeves; and, communication signals to trigger the first, second, and third frac sleeve systems into moving the first and second sleeves to open and close the ports. Also included is a method of completing downhole operations in a non-sequential order.

18 Claims, 10 Drawing Sheets

Related U.S. Application Data

(60) Provisional application No. 61/901,135, filed on Nov. 7, 2013.

(51) Int. Cl.

| | |
|---|---|
| ***E21B 34/06*** | (2006.01) |
| ***E21B 47/12*** | (2012.01) |
| ***E21B 43/14*** | (2006.01) |
| ***E21B 33/124*** | (2006.01) |
| ***E21B 34/12*** | (2006.01) |
| *E21B 34/00* | (2006.01) |

(52) U.S. Cl.
CPC ..... *E21B 43/14* (2013.01); *E21B 43/26* (2013.01); *E21B 47/122* (2013.01); *E21B 2034/007* (2013.01)

(56) References Cited

U.S. PATENT DOCUMENTS

| | | | |
|---|---|---|---|
| 7,387,165 | B2 | 6/2008 | Lopez de Cardenas et al. |
| 7,617,880 | B2 | 11/2009 | Loughlin |
| 7,694,746 | B2 | 4/2010 | Richard et al. |
| 8,169,854 | B2 | 5/2012 | Godager |
| 8,210,257 | B2 | 7/2012 | Dusterhoft et al. |
| 8,505,639 | B2 | 8/2013 | Robinson et al. |
| 8,567,501 | B2 | 10/2013 | Zimmerman et al. |
| 8,720,553 | B2 | 5/2014 | Tips et al. |
| 2007/0144731 | A1 | 6/2007 | Murray et al. |
| 2008/0247273 | A1 | 10/2008 | Chemali et al. |
| 2009/0084553 | A1 | 4/2009 | Rytlewski et al. |
| 2011/0061875 | A1 | 3/2011 | Tips et al. |
| 2012/0168163 | A1 | 7/2012 | Bertoja et al. |
| 2012/0211221 | A1 | 8/2012 | Mills et al. |
| 2012/0325463 | A1 | 12/2012 | Chatelet et al. |
| 2013/0120093 | A1 | 5/2013 | Deville et al. |
| 2013/0181799 | A1 | 7/2013 | Deville et al. |
| 2014/0083683 | A1 | 3/2014 | Tips et al. |
| 2014/0102708 | A1* | 4/2014 | Purkis ..... E21B 43/26 166/308.1 |
| 2015/0122489 | A1 | 5/2015 | Wood |
| 2016/0194953 | A1 | 7/2016 | Switzer et al. |

OTHER PUBLICATIONS

International Search Report and Written Opinion, International Application No. PCT/US2013/058995; Date of Mailing Jan. 12, 2015, Korean Intellectual Property Office; International Search Report 5 pages; Written Opinion 6 pages.

International Search Report and Written Opinion; International Application No. PCT/US2014/058994, Date of Mailing Jan. 14, 2015, International Search Report 6 pages, Written Opinion; 6 pages.

* cited by examiner

DOWNHOLE COMMUNICATION AND CONTROL SYSTEM AND METHOD FOR NON-SEQUENTIAL DOWNHOLE OPERATIONS

CROSS REFERENCE TO RELATED APPLICATIONS

This application is a divisional of U.S. application Ser. No. 14/258,484 filed Apr. 22, 2014, which claims the benefit of an earlier filing date from U.S. Provisional Application Ser. No. 61/901,135 filed Nov. 7, 2013, the entire disclosure of which is incorporated herein by reference.

BACKGROUND

In the downhole drilling and completion industry, the formation of boreholes for the purpose of production or injection of fluid is common. The boreholes are used for exploration or extraction of natural resources such as hydrocarbons, oil, gas, water, and alternatively for CO2 sequestration. To increase the production from a borehole, the production zone can be fractured to allow the formation fluids to flow more freely from the formation to the borehole. The fracturing operation includes pumping fracturing fluids including proppants at high pressure towards the formation to form and retain formation fractures.

Efforts are continually sought to improve methods for conducting multi stage fracture treatments in wells typically referred to as unconventional shale, tight gas, or coal bed methane. Three common methods currently in use for multi stage fracture treatments include plug and perf stage frac'd laterals, ball drop frac sleeve systems, and coiled tubing controlled sleeve systems. While these systems serve their purpose during certain circumstances, there are demands for increasing depths and flexibility and increasing number of stages. For example, balls and landing seats used in ball drop frac sleeve systems have a limited number of stages in cemented applications and require expensive drill out.

A conventional fracturing system passes pressurized fracturing fluid through a tubular string that extends downhole through the borehole that traverses the zones to be fractured. The string may include valves that are opened to allow for the fracturing fluid to be directed towards a targeted zone. To remotely open the valve from the surface, a ball is dropped into the string and lands on a ball seat associated with a particular valve to block fluid flow through the string and consequently build up pressure uphole of the ball which forces a sleeve downhole thus opening a port in the wall of the string. When multiple zones are involved, the ball seats are of varying sizes with a downhole most seat being the smallest and an uphole most seat being the largest, such that balls of increasing diameter are sequentially dropped into the string to sequentially open the valves from the downhole end to an uphole end. Thus, the zones of the borehole are fractured in a "bottom-up" approach by starting with fracturing a downhole-most zone and working upwards towards an uphole-most zone.

While a typical frac job is completed sequentially in the bottom-up approach, an alternating stage process has been suggested in which a first interval is stimulated at a toe, a second interval is stimulated closer to the heel, and a third interval is fractured between the first and second intervals. Such a process has been indicated to take advantage of altered stress in the rock during the third interval to connect to stress-relief fractures from the first two intervals. Fracing zones alternately or out of sequence enhances results and improves production, but existing methods are not readily adaptable to this process, and accomplishing this process is not possible with conventional equipment.

Also, conventional multi stage frac methods do not have the technology to evaluate data real time and optimize their operations appropriately. The ability to provide critical real time data to evaluate and properly conduct operations is a desirable feature in downhole operations. Existing methods for installing electrical control lines, however, require splices or connections at each device or monitoring point. These splices require excessive rig time and are prone to failure. In addition, transmission of large amounts of power through control lines is problematic.

As time, manpower requirements, and mechanical maintenance issues are all variable factors that can significantly influence the cost effectiveness and productivity of a multi-stage fracturing operation, the art would be receptive to improved and/or alternative apparatus and methods for downhole communications and improving the efficiency of multi-stage frac operations. The art would be receptive to alternative devices and methods for alternating a sequence of a frac job.

BRIEF DESCRIPTION

A downhole communication and control system configured for use in a non-sequential order of treating a borehole, the system includes a string having at least three ports including first, second, and third longitudinally spaced ports arranged sequentially in a downhole to uphole manner in the string; at least three frac sleeve systems including first, second, and third frac sleeve systems arranged sequentially in a downhole to uphole manner in the string and arranged to open and close the first, second, and third ports, respectively, each frac sleeve system having self-powered, electronically triggered first and second sleeves; and, communication signals to trigger the first, second, and third frac sleeve systems into moving the first and second sleeves to open and close the ports.

A method of completing downhole operations in a non-sequential order using a downhole communication and control system configured for use in a non-sequential order of treating a borehole, the system includes a string having at least three ports including first, second, and third longitudinally spaced ports arranged sequentially in a downhole to uphole manner in the string; at least three frac sleeve systems including first, second, and third frac sleeve systems arranged sequentially in a downhole to uphole manner in the string and arranged to open and close the first, second, and third ports, respectively, each frac sleeve system having self-powered, electronically triggered first and second sleeves; and, communication signals to trigger the first, second, and third frac sleeve systems into moving the first and second sleeves to open and close the ports includes triggering the first frac sleeve system to open the first port; injecting a borehole with fluid through the first port; triggering the third frac sleeve system to open the third port; triggering the first frac sleeve system to close the first port, subsequent triggering the third frac sleeve system to open the third port; injecting a borehole with fluid through the third port; triggering the second frac sleeve system to open the second port; triggering the third frac sleeve system to close the third port, subsequent triggering the second frac sleeve system to open the second port; injecting a borehole with fluid through the second port; and, triggering the second frac sleeve system to close the second port.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
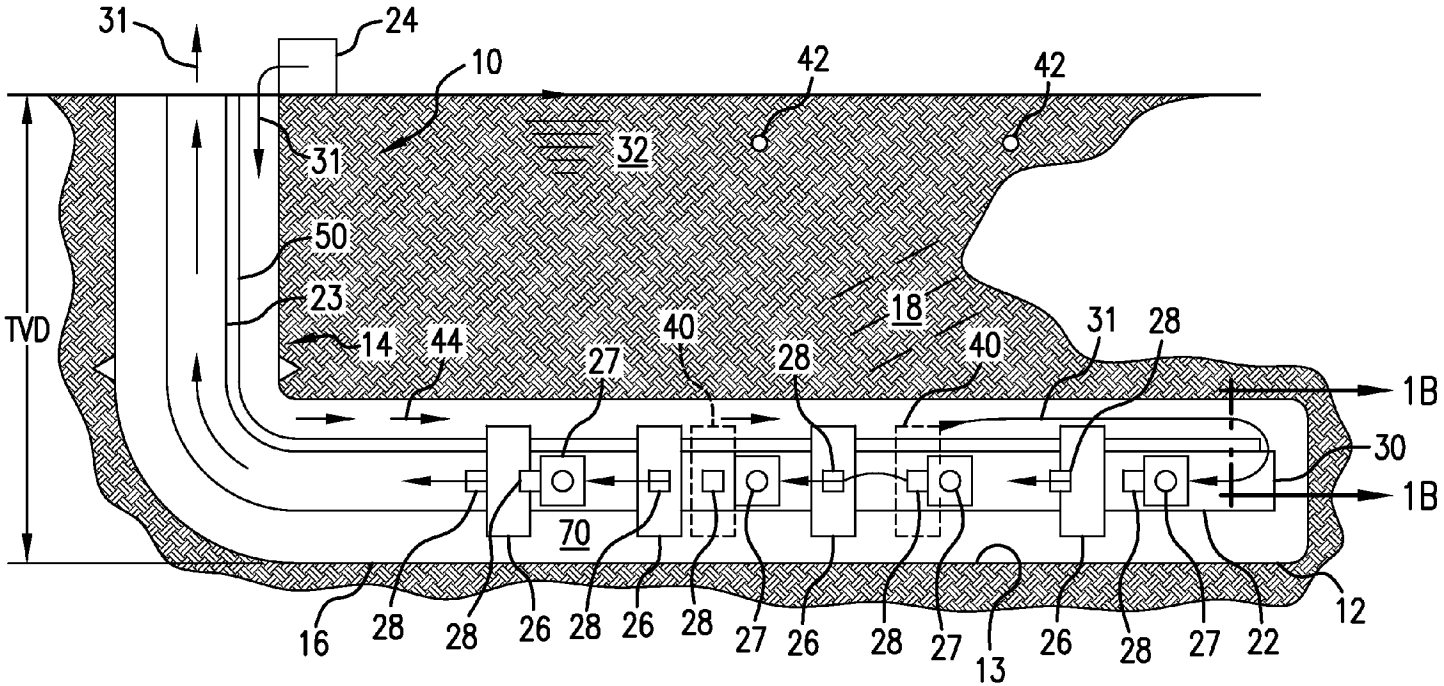
FIG. 1A shows a schematic cross-sectional diagram of an exemplary embodiment of a communication and control system for multi-zone frac treatment.

FIG. 1A shows a communication and control system 10 configured to enable communication in a well or borehole 12. In one exemplary embodiment, the borehole 12 is an extended reach borehole having a vertical section 14 and a highly deviated reach or extension 16. By "highly deviated" it is meant that the extension 16 is drilled significantly away from vertical section 14. The extension 16 may be drilled in a direction that is generally horizontal, lateral, perpendicular to the vertical section 14, etc., or that otherwise approaches or approximates such a direction. For this reason, the highly deviated extension 16 may alternatively be referred to as the horizontal or lateral extension 16, although it is to be appreciated that the actual direction of the extension 16 may vary in different embodiments. A true vertical depth ("TVD") of the borehole 12 is defined by the vertical section 14, and a horizontal or deviated depth or displacement ("HD") is defined by a length of the extension 16 (as indicated above, the "horizontal" depth may not be truly in the horizontal direction, and could instead be some other direction deviated from vertical), with a total depth of the well equaling a sum of the true vertical depth and the horizontal depth. In one embodiment, the total depth of the well is at least 15,000 feet, which represents a practical limit for coiled tubing in this type of well.

The borehole 12 is formed through an earthen or geologic formation 18, the formation 18 could be a portion of the Earth e.g., comprising dirt, mud, rock, sand, etc. A tubular, liner, or string 22 is installed through the borehole 12, e.g., enabling the production of fluids there through such as hydrocarbons.

Figure 1B:
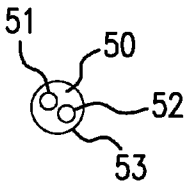
FIG. 1B shows a cross-sectional view of an exemplary embodiment of a control line for the communication and control system of FIG. 1A taken along line 1B-1B in FIG. 1A.

A control line 50 is run into the borehole 12 as part of the instillation of the tubular string 22. The control line 50, as shown in FIG. 1B, includes an outer tube 53, an insulated copper wire 51 that may in some embodiments be grounded in the bottom (toe 30) of the string 22, and in other embodiments return through an interior of the string 22 to a ground at an uphole location. In some applications, a fiber optic cable 52 is also encapsulated in the control line 50. A control unit and/or monitor/operator unit 24 is located at or proximate to the entry of the borehole 12. The unit 24 could be, or include, e.g., a wellhead, a drill rig, operator consoles, associated equipment, etc., that enable control and/or observation of downhole tools, devices, parameters, conditions etc. Regardless of the particular embodiment, operators of the system 10 are in signal and/or data communication with the unit 24, e.g., with various control panels, display screens, monitoring systems, etc. known in the art.

Pluralities of self-powered devices 26 and 27 that do not require a splice or direct connection to the control line 50 are included along the length of the string 22 in the borehole 12. The devices 26 and 27 are illustrated schematically and could include any combination of tools, devices, components, or mechanisms that are arranged to receive and/or transmit signals wirelessly to facilitate any phase of the life of the borehole 12, including, e.g., drilling, completion, production, etc. For example the devices 26 and 27 could include sensors (e.g., for monitoring pressure, temperature, flow rate, water and/or oil composition, etc.), chokes, valves, sleeves, inflow control devices, packers, or other actuatable members, etc., or a combination including any of the foregoing.

Frac Sleeve systems are represented by the devices 27, and packing systems are represented by the devices 26. In one exemplary embodiment, the devices 26 are swellable packers that allow for the control line 50 to be inserted in an axial groove therein for instillation. These types of packers react to well fluids and seal around the control line 50 without the need for a splice. The devices 26 and 27 may further comprise sensors for monitoring a cementing operation. Of course any other operation, e.g., fracing, producing, etc. could be monitored or devices used for these operations controlled. All devices 26, 27 are capable of receiving commands from the control line 50 by induction or other communication modes without splices in the control line 50. Each of the devices 26, 27 is capable of storing its own power if required in the form of an atmospheric chamber, chemical reaction, stored gas pressure, battery, capacitor or other means. Thus, the devices 26, 27 are self-powered tools.

Advantageously, system 10 enables signal communication between devices, units, communicators, etc., (e.g., between the devices 26 and 27 and the unit 24) that would not have been able to communicate without splices in a control line in prior systems. The control line 50 is secured to tubing string 22, such as by strapping or otherwise fastening, which is a relatively simple process and requires minimal additional hardware or rig time from a deployment point of view, as compared to splices of a conductor which require additional hardware and slow down the deployment of such a cable. Since the purpose of the control line 50 in the system 10 is to wirelessly transmit a communication/triggering signal (as opposed to delivering power to a device) then splices can be avoided if, in one exemplary embodiment, the communication is transmitted inductively. Due to the devices 26, 27 having self-contained sufficient power to move from first to second conditions, the only requirement of the control line 50 is to provide the triggering signal. At a given location and fairly proximate a device's electronic trigger (as will be further described below), the control line 50, such as an encapsulated conductor (tubing encapsulated cable "TEC" or Hybrid Cable), passes through or by an inductive coupling device 40, shown in phantom, to detect the transmission of an electrical signal. The inductive coupling device 40 employs near field wireless transmission of electrical energy between a first coil or conductor in the inductive coupling device 40 and a second coil or conductor electrically connected to the electronic trigger in the device 26, 27, so that current can be induced in a conductor within the device 26, 27 without making direct physical contact with the control line 50 on the exterior of the string 22. The magnetic field in the inductive coupler 40 will induce a current in the device 26, 27. The power or amplitude of the signal is only important in that it must be substantial enough to produce an inductive measurement through the cable armor (outer tube 53). As the same control line 50 may pass through or by a plurality of inductive couplers 40, the frequency or pattern of the inductive signal sent by the control line 50 could be used to communicate with a specific selected trigger within one of the devices 26, 27 located along the string 22. The system 10 thus enables a method for conducting multi stage frac operations combining control line telemetry, without the need for splices and power transmission, with electronically triggered downhole self-powered driven devices 26, 27.

In another exemplary embodiment, variable frequency current 31 is sent down the insulated copper wire 51. The copper wire 51 is electrically connected to the toe 30 of the string 22 with return ground for the current placed at surface in unit 24, the well head or some distance from the wellhead in an appropriate surface location 32 relative to extension 16. Since long wavelength EM Through Earth signals will be generated by long wavelength current and these signals travel through the earth/formation 18 placement of the ground may be selected to allow for measurement of resistivity changes in the subsurface formations as water displaces oil. The signal may also be modulated by devices 26 and 27 and gap subs 28 (as will be further described below) in the string 22 to carry telemetry data. These EM telemetry techniques complete a circuit and enable signals in the form of current pulses or the like to be picked up and decoded, interpreted, or converted into data. In an additional exemplary embodiment, surface communicators 42 may be provided at or proximate the surface 32 to provide communication between the devices 26, 27 and gap subs 28 or other downhole communicators provided along the string 22 and the control/monitoring unit 24. Such intermediate communicators are further described in U.S. Patent Publication No. US 2013/0306374, herein incorporated by reference in its entirety.

Figure 3:
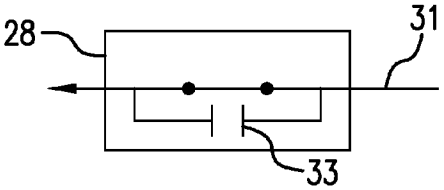
FIG. 3 shows a circuit diagram of an exemplary embodiment of a gap sub in the communication and control system of FIG. 1A in a closed condition.
Figure 2:
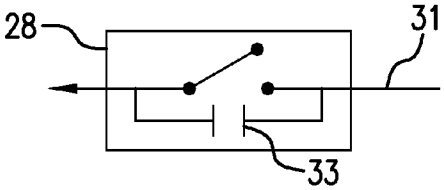
FIG. 2 shows a circuit diagram of an exemplary embodiment of a gap sub in the communication and control system of FIG. 1A in an open condition.

As further shown in FIG. 1A, and with reference to FIGS. 2 and 3, each device 26 and 27 may also have an electrical insulation section or gap sub 28 to allow for interruption or control of current flow at that location in string 22. The current 31 is delivered in a downhole direction 44 via the spliceless control line 50 from the well head, e.g. control unit 24 or surface 32, to the toe 30, at which point it is redirected in an uphole direction 46 to the devices 26, 27, 28 within the string 22. Thus, this embodiment does not require the inductive coupling devices 40. In the electrically closed position shown in FIG. 3, current will flow through the gap sub 28 with no effective resistance and in the open position, shown in FIG. 2, no current 31 will flow through the gap sub 28. By varying resistance from open to closed positions, data from measurements such as pressure, temperature, valve movement etc may be communicated to surface 32. It is also understood that instructions may be encoded in the current 31 to command action in any individual device 26, 27 and each device 26, 27 may send data back to surface 32. In addition to telemetry, the gap sub device 28 may contain capacitors or batteries 33 that are charged by the current 31.

With respect to FIGS. 1A to 3, the system 10 may include a spliceless control line 50 in communication with end devices 26, 27, 28 wherein the spliceless control line 50 is at least spliceless from downhole to uphole at least two adjacent end devices 26, 27, 28. The system 10 includes a plurality of devices 26, 27, 28 and the system 10 includes a spliceless control line 50 extending in a spliceless manner from downhole of the downhole most device, e.g. device 27 closest to toe 30, to uphole of the uphole most device, e.g. device 28 closest to vertical section 14, of the plurality of devices 26, 27, 28.

Figure 5:
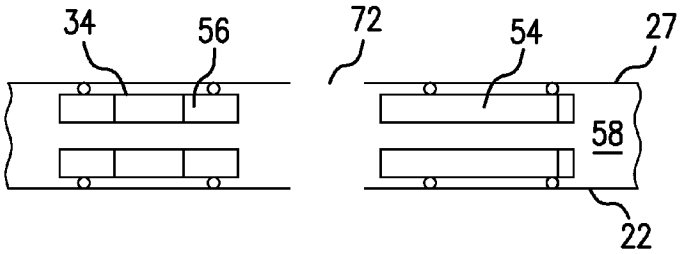
FIG. 5 shows a schematic cross-sectional diagram of the first and second sleeve assemblies of the sleeve system of FIG. 4 in an open condition.
Figure 4:
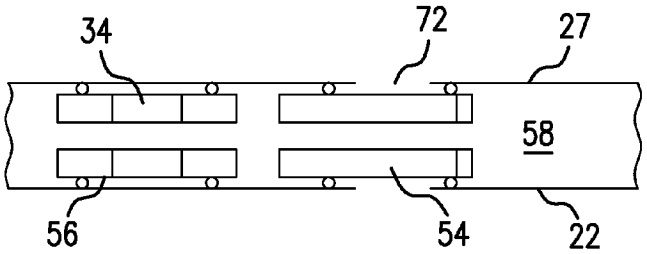
FIG. 4 shows a schematic cross-sectional diagram of an exemplary embodiment of first and second sleeve assemblies of a sleeve system in a run-in condition for use in the communication and control system of FIG. 1A.
Figure 7:
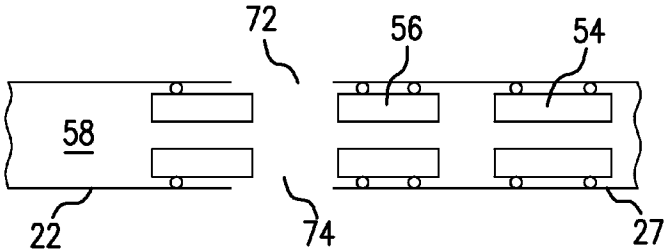
FIG. 7 shows a schematic cross-sectional diagram of the first and second sleeve assemblies of the sleeve system of FIG. 4 with a dissolvable insert of the second sleeve assembly disintegrated.

Turning now to FIGS. 4-7, a method of conducting multiple stage fracture treatments in a borehole 12, or other downhole treatments such as, but not limited to, chemical injection, steam injection, etc., is shown to include installing at least one sleeve system 27 having two or more sleeve assemblies 54, 56 that have a first closed position, such as the run-in condition shown in FIG. 4, and a second open position as shown in FIG. 5, relative to radial communication from an interior 58 of the string 22 to the annulus 70 (FIG. 1A) between the exterior 23 of the string 22 and the borehole wall 13 of the borehole 12. The self-powered first and second sleeve assemblies 54, 56 have sufficient stored energy to move from the first to the second position. The instructions from the control line 50 to one of the two or more sleeve assemblies 54, 56 to move from the first closed position to the second open position may be delivered via induction or control line 50 from the toe 30 and gap subs 28 as described above. The open position shown in FIG. 5 reveals one or more ports 72 in the string 22. Fracturing fluid may then be injected through the frac sleeve system 27, through the ports 72, and into the annulus 70 towards the borehole wall 12 to initiate fractures in the formation 18. After the fracturing operation, or other downhole treatment or injection, is completed, instructions from the control line 50 trigger the second sleeve assembly 56 to move to the third closed position shown in FIG. 6, to block the ports 72. The closed second sleeve assembly 56 may additionally include at least one dissolvable material or disintegration insert 34 that will disintegrate, leaving a corresponding number of apertures 74 in the sleeve assembly 56, substantially aligned with the ports 72, as shown in FIG. 7, after all zones have been treated. In one exemplary embodiment, the insert 34 may be made of a controlled electrolytic metallic ("CEM") nanostructure material, such as the material used in IN-Tallic™ disintegrating frac balls available from Baker Hughes, Inc. The insert 34 thus dissolves, whereas the remainder of the second sleeve assembly 56 does not. At this point, another frac sleeve system 27 may be moved in the manner shown in FIGS. 4-7 to open, perform a fracturing operation, and subsequently close the first and second sleeve assemblies 54, 56. The sequence can be repeated for any number of frac sleeve systems 27 in any order. Frac treatments of alternate zones will be further described below with respect to FIGS. 14A-15.

Figure 6:
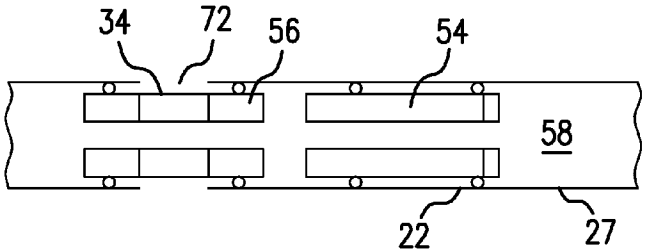
FIG. 6 shows a schematic cross-sectional diagram of the first and second sleeve assemblies of the sleeve system of FIG. 4 in a closed condition.
Figure 9:
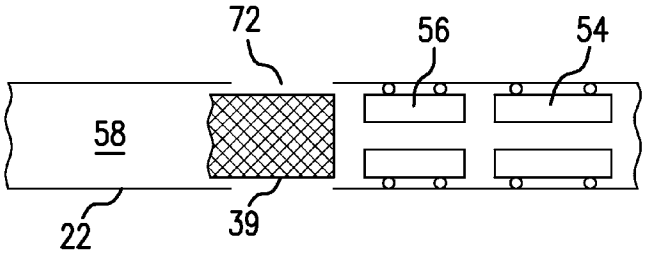
FIG. 9 shows a schematic cross-sectional diagram of the first and second sleeve assemblies of the sleeve system of FIG. 8 with an exemplary filter.
Figure 8:
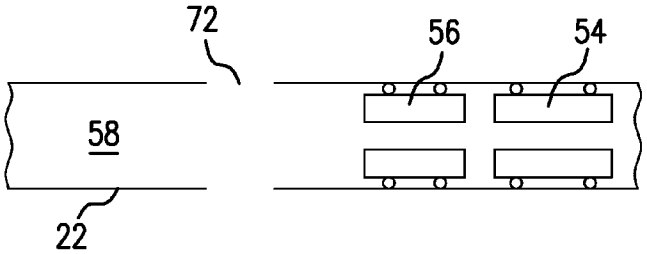
FIG. 8 shows a schematic cross-sectional diagram of an alternate embodiment of the first and second sleeve assemblies of the sleeve system of FIG. 4 with the second sleeve assembly exposing the port for production.

In lieu of providing a dissolvable insert 34 as shown in FIGS. 4-6, a fourth open position is shown in FIG. 8. The second sleeve assembly 56 in this embodiment would be required to contain at least sufficient power to move this second time, and may include a second electronic trigger to initiate this additional movement. To produce through the ports 72, the second sleeve assembly 56 is moved an additional time from the closed position shown in FIG. 6 to the open position shown in FIG. 8. Additional sleeve assemblies 56 may be opened after treatment for production. The production sleeves may have a screen or filter 39 as shown in FIG. 9.

Figure 10:
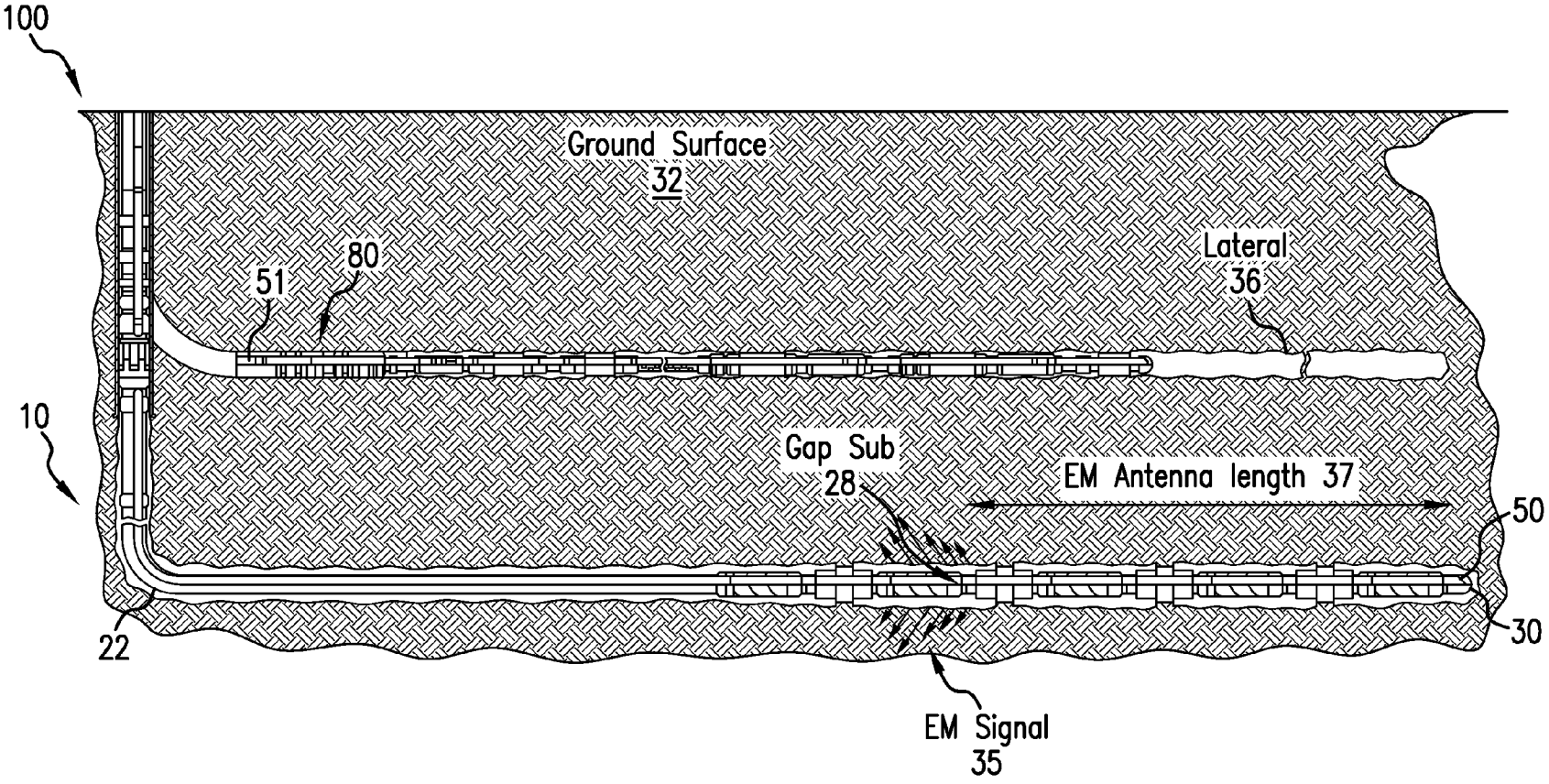
FIG. 10 shows a schematic cross-sectional diagram of an exemplary embodiment of a communication and control system for multi-zone frac treatment for a multi lateral well.

FIG. 10 shows a communication and control system 100, which expands upon the communication and control system 10 by including the string 22 as previously described with respect to FIG. 1A as a main or first lateral, and additionally including a lateral borehole 36 in a stacked lateral configuration with the main borehole 12 for a multilateral system. The lateral borehole 36 contains a lateral casing, liner, string tubular 80, etc. and may further include an additional control line 51 extending along the tubular 80. A method of wireless EM through-earth communication from the string 22 (the main bore lateral) to the tubular 80 (a branch multi lateral well section) includes installing the control line 50 onto the liner 22 (as in FIG. 1A), activating one or more gap subs 28 to the electrically open position (FIG. 2) to insulate an uphole portion of the string 22 from a downhole portion of the string 22 relative to a location of the electrically opened gap sub 28, forming an EM antenna 37 having an approximate length of the downhole portion of the string 22, sending EM signals 35 to the tubular 80 in the lateral borehole 36 or another lateral (not shown) or surface 32. By activating various gap subs 28 along the string 22, the antenna length 37 will be varied. Then, the strength of the signal 35 from the borehole 12 to the surface 32 or other laterals 36 can be measured. Measurements can be used to determine effective resistance of the formation 18 indicating water movement.

Each transmitter site on the string 22 can contain a non-conductive coupling via the gap sub 28, electrically isolating the section of the string 22 downhole the transmitter from that uphole. The transmitting current, EM signal 35, is injected into the formation 18 across this nonconductive section (at opened gap sub 28), and the resultant field is detected by electrodes at the surface 32 or sea floor or by the lateral 36. The downhole transmitter can be impedance-matched to the surrounding formation 18 to achieve power efficiency. For land-based applications, at the surface 32, transmitter current can be injected into the formation 18 through electrodes (not shown) driven into the formation 18 at some distance from the wellhead (see, for example, locations of surface communicators 42 shown in FIG. 1A). A portion of the transmitter current can flow along the length of the downhole string 22 and be detected at the nonconductive coupling, gap sub 28. To transmit data back to the surface 32, a current will be injected across the two isolated sections of the downhole string 22, and sensed at the electrodes as it flows back to the surface 32. For shallow offshore applications, the technique can be similar, with the electrodes replaced by an exposed conductor on a cable, laid on the sea floor.

Figure 11:
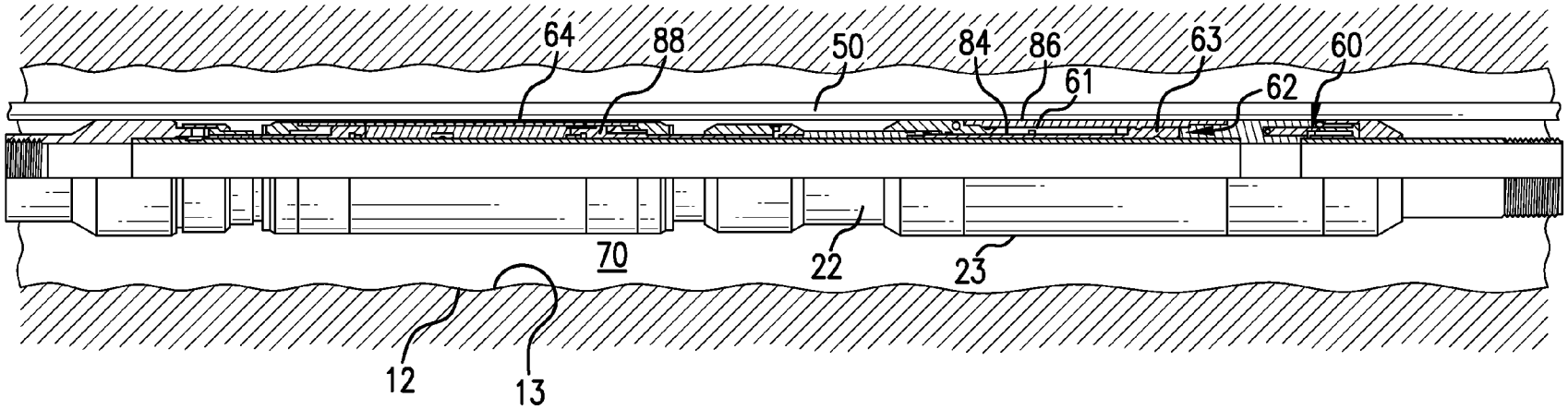
FIG. 11 shows a partial cross-sectional view of an exemplary embodiment of an electronically-triggered, self-powered packer for use in the communication and control system of FIG. 1A.

Turning now to FIG. 11, an exemplary embodiment of the device 26 will be described. The device 26 includes an electronic trigger 60 to activate a packer element 64, similar to Baker Hughes's MPas-e commercially available remote-set packer system with eTrigger technology. This packer's trigger is typically adapted to be activated by time, pressure, temperature, accelerometers, magnetic or RFID methods. Operational actions of this packer are accomplished by activation of atmospheric chambers 61 that are opposed by hydrostatic pressure 62. However, in the embodiments of a device 26 described herein, the electronic trigger 60 of the device 26 may be alternatively or additionally activated from a radial exterior location 23 of the string 22 via induction (through inductive coupling device 40 shown in FIG. 1A) or EM telemetry, or from a toe 30 of the string 22 to the electronic trigger 60, such as via the control line 50 and gap subs 28, as shown in FIGS. 1-3 and 10, to provide the system 10 described herein with real time two way telemetry or data transmission. Thus, the system 10 described herein is a more versatile alternative.

The device 26 employs an energy source that is contained within the packer system 26 prior to disposing the string 22 into the borehole 12. An inner collar 84 is disposed radially within an outer collar 86, and the chamber 61 is defined radially between the two collars 84, 86. The inner collar 84 may include or be operatively engaged with a compression portion 88 that lies in contact with the packer element 64. The electronic trigger 60 includes an actuator and a programmable electronic transceiver that is designed to receive a triggering signal from the control line 50, inductive coupling device 40, EM telemetry, gap subs 28, all as previously described. The actuator may be operably associated with setting piston 63 to expose the setting piston 63 to hydrostatic pressure 62 upon receipt of the signal from the transmitter, whether the transmitted signal is from the control line 50 and gap sub 28, inductive coupling device 40, EM telemetry. The chamber 61 may be an atmospheric chamber, which will create a pressure differential across the setting piston 63 due to its exposure to the higher pressure hydrostatic pressure 62 which will urge the portion 88 operatively connected to the inner collar 84 toward the packer element 64 compressing it to a set position filling the annulus 70 to the borehole wall 13 in the area of the packer element 64, enclosing the control line 50 therein. If desired, a delay could be incorporated into the programming of the actuator of the e-trigger 60 such that a predetermined period of time elapses between the time the triggering signal is received by the e-trigger 60 and the setting piston 63 is exposed to the hydrostatic pressure 62. When the setting piston 63 is exposed to the hydrostatic pressure 62, the pressure differential will urge the inner collar 84 (and associated compression portion 88) axially towards the packer element 64 so that the portion 88 compress the packer element 64. The packer element 64 will be deformed radially outwardly to seal against the borehole wall 13.

Figure 12A:
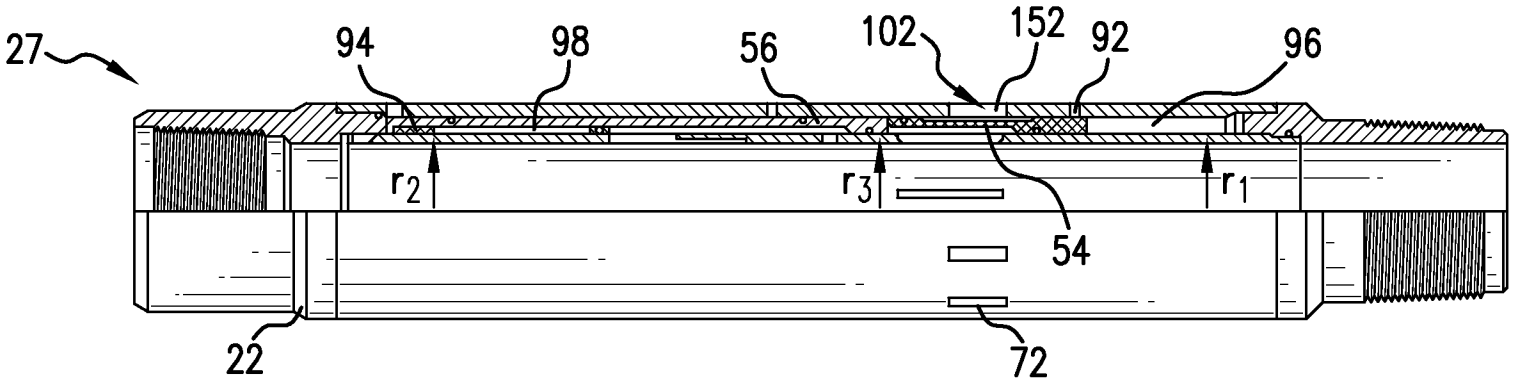
FIGS. 12A-12C show a partial cross-sectional view of run-in position, open position, and closed positions of an exemplary embodiment of an electronically-triggered, self-powered frac sleeve system for use in the communication and control system of FIG. 1A.
Figure 12B:
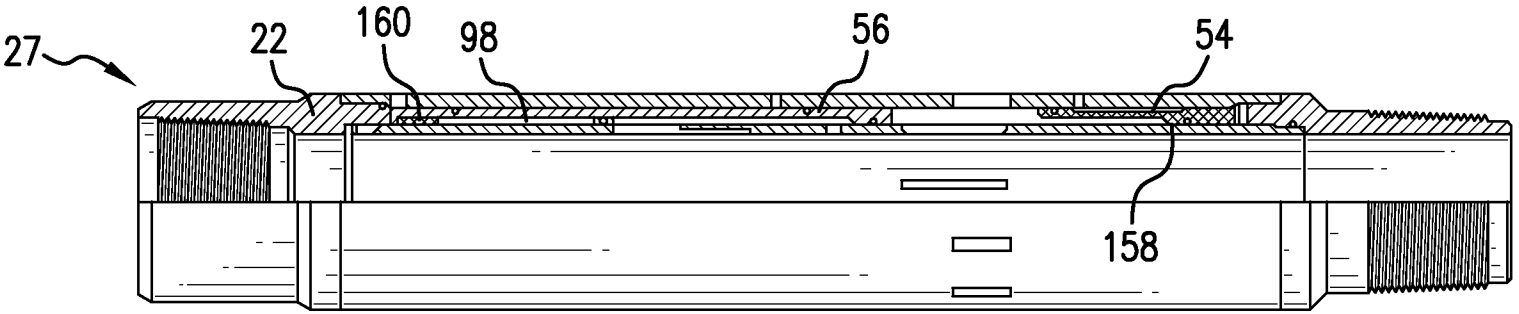
Figure 12C:
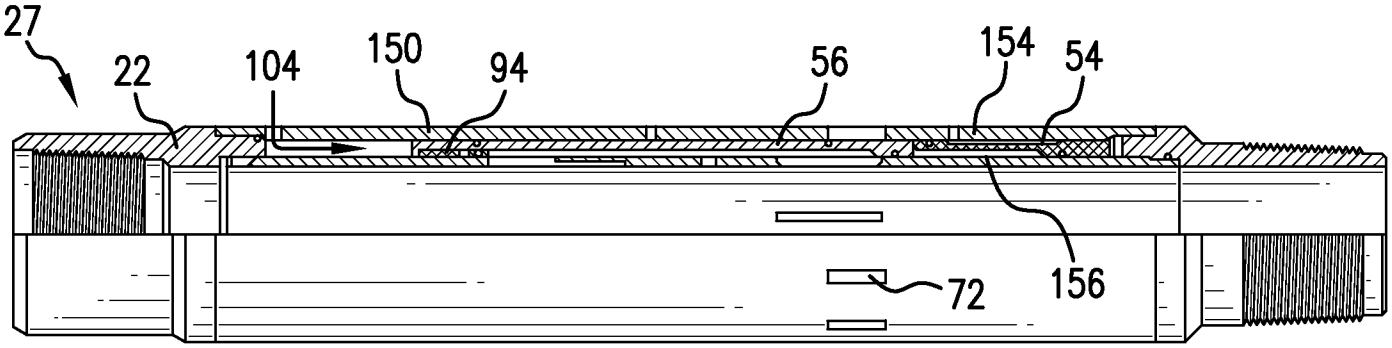

One exemplary embodiment of a device 27 is shown in FIGS. 12A-12C. The device 27, or frac sleeve system 27, includes both the first and second sleeve assemblies 54, 56, as shown in FIGS. 4-7, and thus the device 27 includes first and second electronic triggers 92, 94 to trigger movement of the first and second sleeve assemblies 54, 56, respectively. The device 27 includes a body 150 having first and second openings 152 (FIG. 12A), 154 (FIG. 12C), and first and second enclosed chambers 96, 98 within the body 150 enclosing a pressure source, such as atmospheric pressure, that is less than that of downhole hydrostatic pressure. The body 150 may include an inner collar 154 and an outer collar 156 housing the sleeve assemblies 54, 56, electronic triggers 92, 94, and the chambers 96, 98 there between. As with the device 26, operational actions of this device 27 are accomplished by the introduction of hydrostatic pressure 102, 104 through openings 152, 154 which overcome first and second atmospheric chambers 96, 98 on opposite sides of a setting piston or valve which operatively move the first and second sleeve assemblies 54, 56. The setting piston or valve may take the form of a portion of the sleeve assemblies 54, 56, or a separate member that is operatively connected to the sleeve assembly 54, 56, such that movement of such a piston translates to movement of the sleeve assembly 54, 56, either simultaneously or subsequently. The embodiment shown in FIGS. 12A-12C employ piston members 160 that are directly engaged with respective first and second sleeves 54, 56 and move therewith. Also, in the embodiments of a device 27 described herein, the electronic triggers 92, 94 of the device 27 are activatable from a radial exterior location 23 of the string 22 such as via induction, or from a toe of the string 22 to the electronic triggers 92, 94, such as via the spliceless control line 50 and gap subs 28, as shown in FIGS. 1-3 and 10, to provide the system 10 described herein with real time two way telemetry or data transmission. Via the first and second atmospheric chambers 96, 98, and opposing introduction of hydrostatic pressure 102, 104, the device 27 employs an energy source that is contained within the system 10 and contains sufficient power to move the sleeves 54, 56 from first to second positions with respect to the ports 72 of the string 22 prior to disposing the string 22 into the borehole 12. FIG. 12A shows a run-in position where the first sleeve 54 is positioned to cover the ports 72 in the string 22. When the first electronic trigger 92, which includes an actuator and a programmable electronic transceiver, receives a trigger signal, the actuator exposes piston member 158 to hydrostatic pressure 102 via opening 152 to move the first sleeve 54 in the position shown in FIG. 12B, exposing the ports 72 to the annulus 70. A fracturing treatment or other injection operation may then be performed through the open ports 72. Turning now to FIG. 12C, when it is time to close the ports 72, the second electronic trigger 94 receives a triggering signal such that an actuator exposes piston member 160 (adjacent trigger 94) having the atmospheric chamber 98 on one side, to hydrostatic pressure 104 via opening 154 on the other side, forcing the second sleeve 56 into the closed position covering the ports 72. The exact arrangement of the piston members 158, 160, triggers 92, 94, chambers 110, 112, sleeves 54, 56, and openings 152, 154 may be adjusted as needed for a particular string 22, however it is important to note that the inner diameter of the device 27, as exemplified by a radius r1 at a downhole portion of the body 150, radius r2 adjacent an uphole portion of the body 150, and radius r3 in a central portion of the body 150, is substantially constant due to a substantially constant inner diameter of the inner collar 154 which forms the innermost portion of the device 27. No ball seats are required to operate the frac sleeve assembly 27 that would reduce the inner diameter.

Figure 13A:
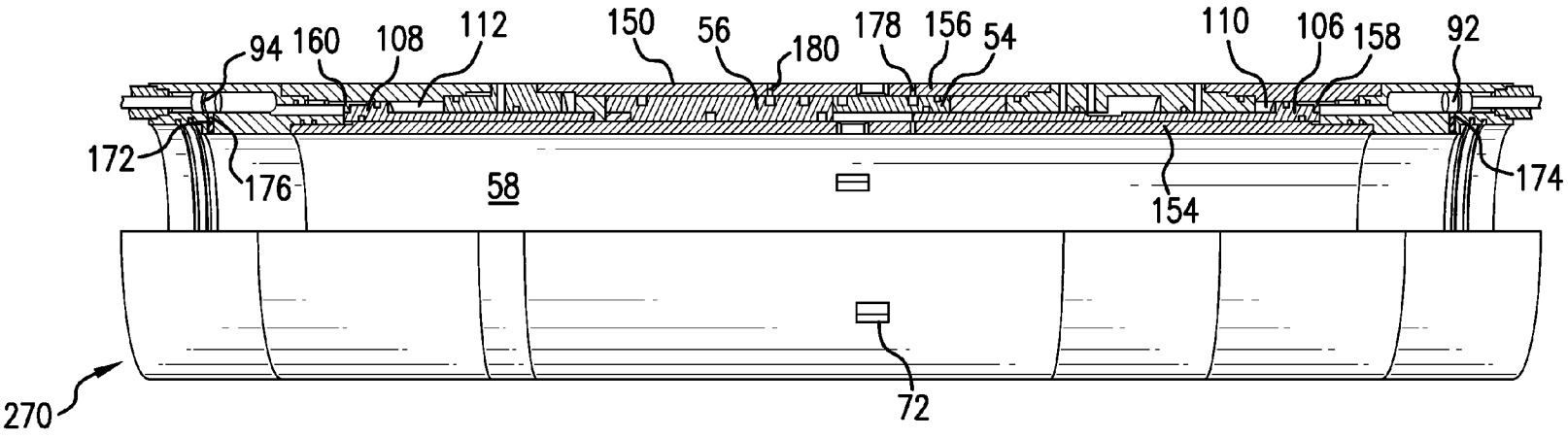
FIGS. 13A-13D show a perspective cut-away view of run-in position, intermediate auxiliary sleeve activation, open position, and closed positions of another exemplary embodiment of an electronically-triggered, self-powered frac sleeve system for use in the communication and control system of FIG. 1A.
Figure 13B:
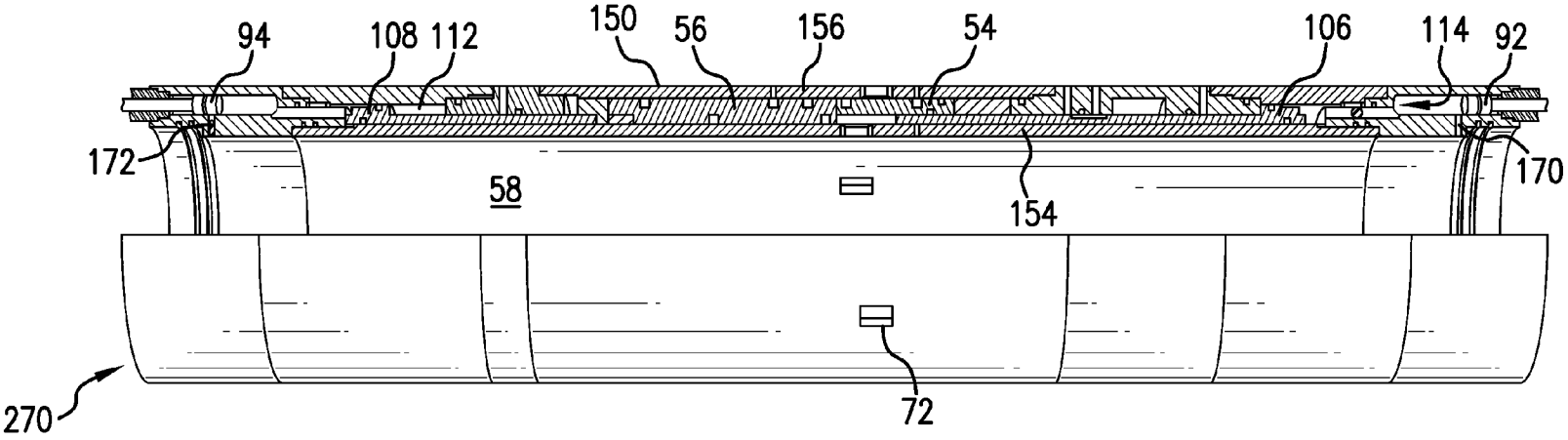
Figure 13C:
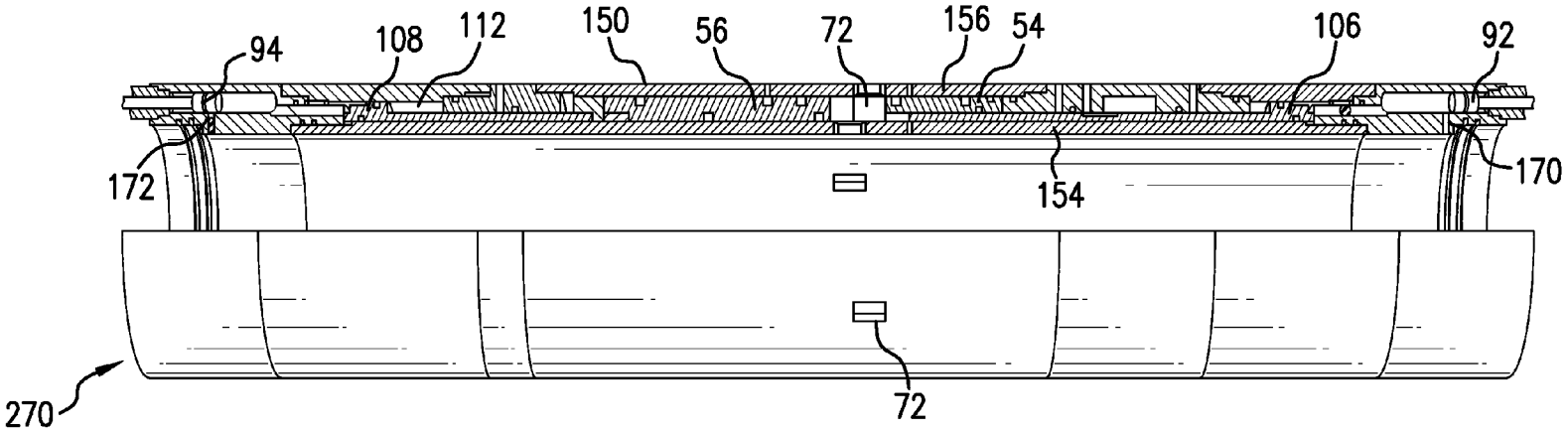

Another exemplary embodiment of a device 270 is shown in FIGS. 13A-13C. The device 270, or frac sleeve system 270, includes both the first and second sleeves 54, 56, as shown in FIGS. 4-7, and thus the device 270 includes first and second electronic triggers 92, 94. The sleeve system of FIGS. 13A-13C is distinguished from the sleeve system of FIGS. 12A-12C by first and second intermediate auxiliary sleeves 106, 108, that are actuated by the electronic triggers 92, 94 to engage with and move the respective first and second sleeves 54, 56. Also, in lieu of openings 152, 154 of FIGS. 12A-12C which open to the annulus pressure to overcome atmospheric chambers, the device 27 of FIGS. 13A-13D may include openings 170, 172 in the body 150 that are openable to tubing pressure, which is also higher than the pressure enclosed by chambers 110, 112. The openings 170, 172 may each contain a snap ring, or C-ring, or other expandable ring 174, 176 that are released from the openings 170, 172 when the triggers 92, 94 are actuated to move longitudinally away from the openings 170, 172. After the rings 174, 176 are released, the piston members 158, 160 (in this case associated with the first and second intermediate auxiliary sleeves 106, 108) are exposed to the tubing pressure from the interior 58 of the string 22 and move as previously described. As with the device 26, operational actions of this device 270 are accomplished by atmospheric chambers 110, 112 that are overcome by portions of the first and second intermediate auxiliary sleeves 106, 108 that are acted upon by the introduction of higher pressure 114 (FIG. 13B) and 116 (FIG. 13D), in this case from the tubing interior 58. Also, in the embodiments of a device 270 described herein, the electronic triggers 92, 94 of the device 270 are activatable from a radial exterior location 23 of the string 22. The device 270 thus employs an energy source that has sufficient power to move the first and second sleeves 54, 56 and that is contained within the system 10 prior to disposing the string 22 into the borehole 12.

Figure 13D:
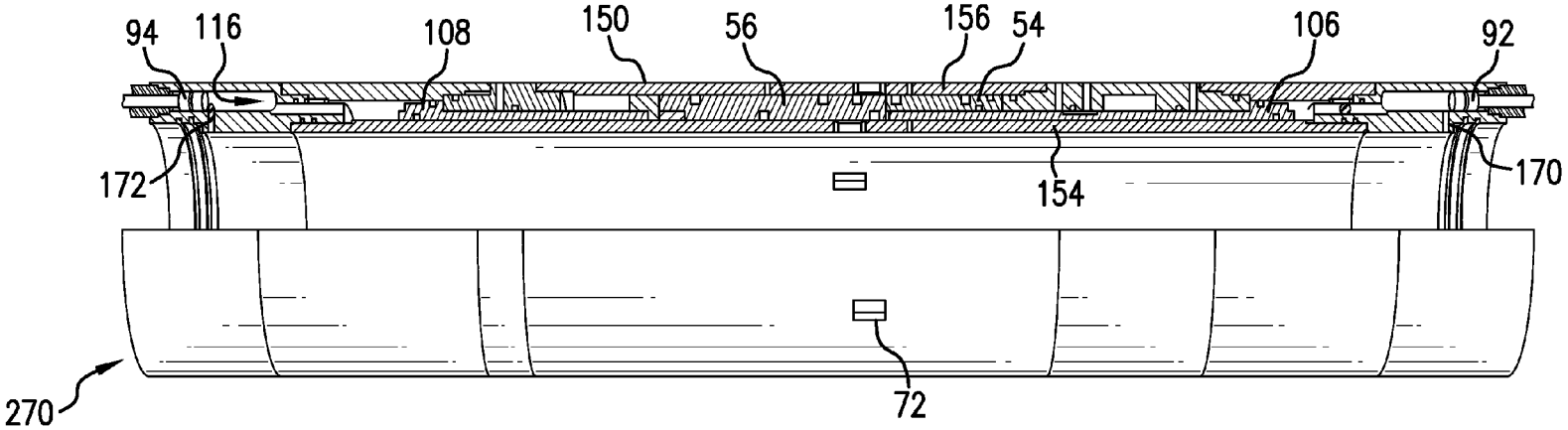

FIG. 13A shows a run-in position where the first sleeve 54 is positioned to cover the ports 72 in the string 22. Turning to FIG. 13B, when the first electronic trigger 92, which includes an actuator and a programmable electronic transceiver that is designed to receive a triggering signal from the control line 50, or induction or EM telemetry as previously described, receives a trigger signal, the first intermediate auxiliary sleeve 106 moves to release the first sleeve 54. The first and second sleeves 54, 56 may be initially secured in their run-in position by shear pins 178, 180 that are sheared by forceful longitudinal movement of the respective first and second intermediate auxiliary sleeves 106, 108. FIG. 13C shows the first sleeve 54 moved to the position shown, leaving the ports 72 exposed. A fracturing treatment or other injection operation may then be performed through the open ports 72. Turning now to FIG. 13D, when it is time to close the ports 72, the second electronic trigger 94 receives a triggering signal such that the second intermediate auxiliary sleeve 108 moves to release the second sleeve 56, forcing the second sleeve 56 into the closed position covering the ports 72.

In both the embodiments of the sleeve systems 27, 270 shown in FIGS. 12A-12C and FIGS. 13A-13D, the second sleeves 56 may further include the dissolvable insert 34 such that production may be accomplished through the second sleeve 56 as previously described with respect to FIG. 7. Also, the sleeve systems 27, 270 may include first and second threaded end portions to connect with other devices 26, 28, and/or blank tubulars to form the string 22.

Figure 14A:
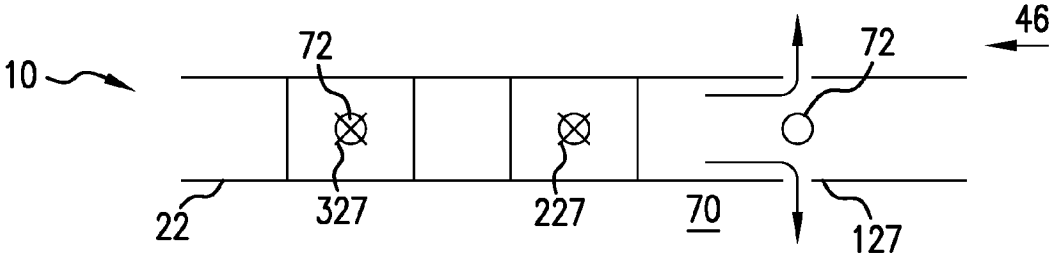
FIGS. 14A-14C depict a side schematic view of an exemplary embodiment of an operation of three frac sleeve systems in the communication and control system of FIG. 1A; and, FIG. 15 shows a side schematic view of an exemplary embodiment of a frac stage order of multiple frac sleeve systems in the communication and control system for multi-zone frac treatment shown in FIG. 1A.
Figure 14B:
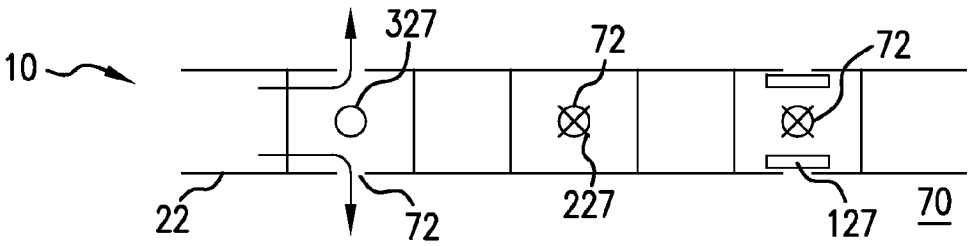
Figure 14C:
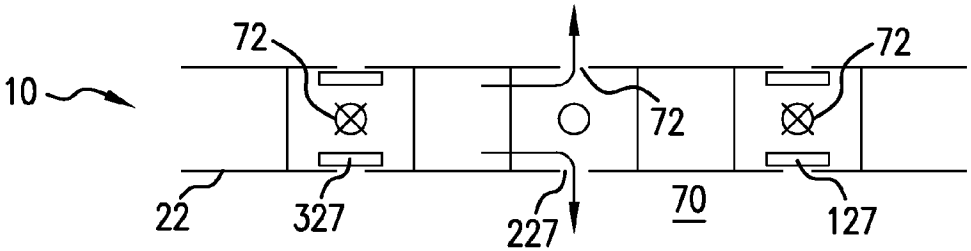
Figure 15:
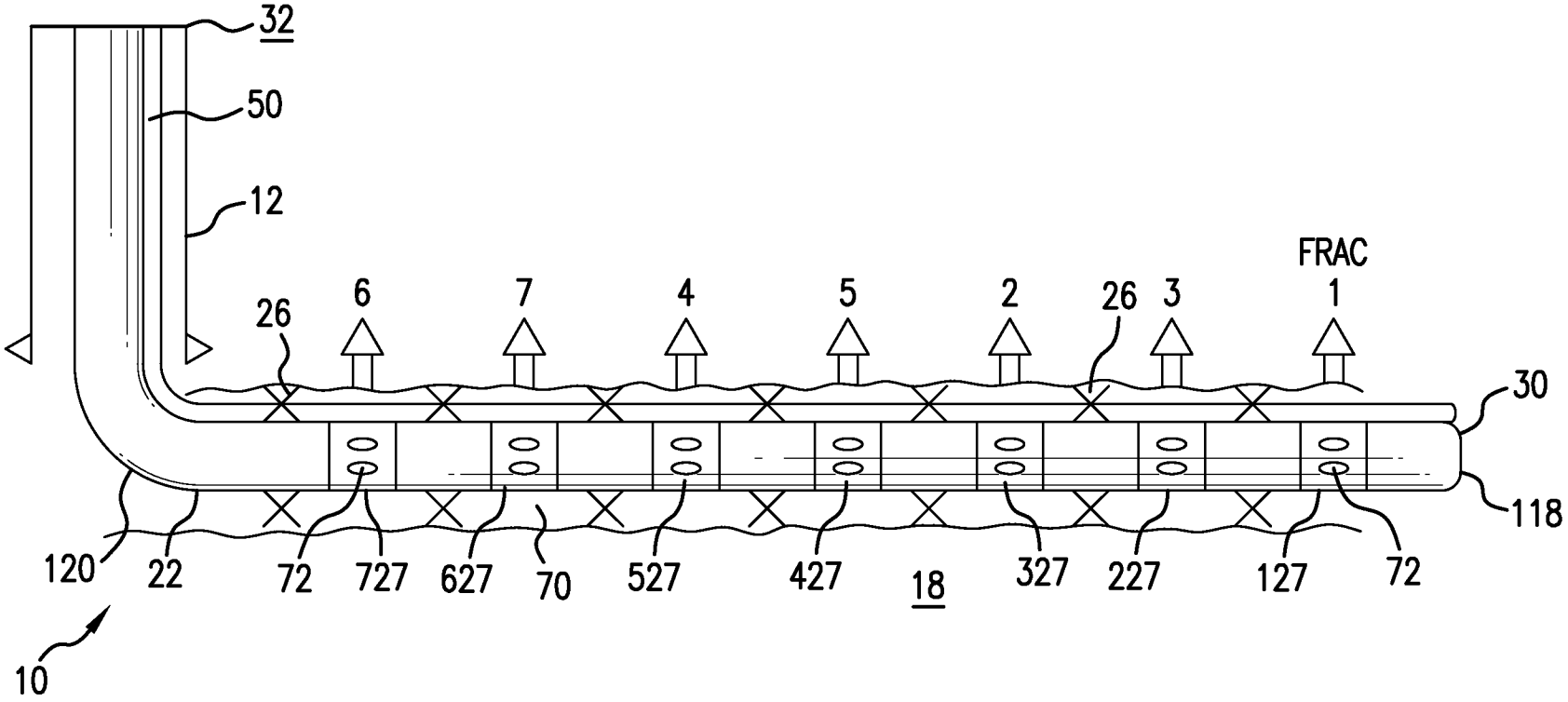

Turning now to FIGS. 14A-15, an exemplary embodiment of utilizing the above-described system 10 is shown, although the system could also be advantageously employed with the system 100. The exemplary method will include any number of frac sleeve systems 27 or 270, with packing systems 26 disposed there between, however for the purpose of simplicity, only the installation of three frac sleeve systems 27 is shown in FIGS. 14A-14C, which are numbered 127, 227, 327 to indicate a first frac sleeve system 127, a second frac sleeve system 227, and a third frac sleeve system 327, numbered in consecutive order in an uphole direction 46 of the string 22. The three frac sleeve systems 27 have a first closed position for run-in, a second open position relative to radial communication from inside the string 22 to the annulus 70 for treatment of surrounding formation 18, and a third closed position, all as previously described with respect to FIGS. 4-8, 12A-12C, and FIGS. 13A-13D, and may further include a fourth open position for subsequent production, as shown in FIG. 7 via a dissolved insert or as in FIG. 8 with a moved second sleeve. The frac sleeve systems 27 contain sufficient power to at least move from one position to the next. Telemetry from the control line 50 such as by direct induction from outside or current flow through the string 22 and gap sub 28 instructs the first frac sleeve system 127, and more particularly the respective first sleeve assemblies 54, to move from the run-in closed position to the second open position. The formation 18 is then treated by injection fluid, such as fracturing fluid, although other fluid injection such as steam or chemical may also be considered, through the sleeve system 127. The third frac sleeve system 327 is then instructed (triggered) to open. The first frac sleeve system 127 is closed to force treating fluid through the third frac sleeve assembly 327. The second frac sleeve system 227 is then opened. The third frac sleeve system 327 is then closed forcing fluid through the opened second frac sleeve system 227.

FIG. 15 illustrates the sleeve system 10 within borehole 12, the borehole 12 extending from a surface location 32, to a downhole location 118. The borehole 12 may be a horizontal borehole as shown, and the sleeve system 10 includes a heel portion 120 at a bend of the sleeve system 10, and a toe portion 30 at a downholemost end of the sleeve system 10. Packing systems 26 isolate sections of the annulus 70 surrounding the ports 72. The system 10 includes any number of tubulars to complete the string 22, for example, each device 26, 27, 28 may include separate sections of the overall string 22. An exemplary order of operations is indicated within the borehole 12, with "Frac 1" indicating that the ports 72 nearest the toe portion 30 are opened first using a first frac sleeve system 127. Frac "2" indicates that the ports 72 further uphole from the toe portion 30 are opened next using a third frac sleeve 327. Frac "3" indicates that the ports 72 between the locations for Frac "1" and Frac "2" are opened third using a second frac sleeve system 227. Subsequently, Frac "4" indicates that the ports 72 further uphole from the Frac "2" location are opened next using a fifth frac sleeve system 527. Frac "5" indicates that the ports 72 between the locations for Frac "4" and Frac "2" are opened next using a fourth frac sleeve system 427. Then, Frac "6" indicates that the ports 72 are opened further uphole from the location of Frac "4" using seventh frac sleeve system 727. Frac "7" indicates that the ports 72 between the locations for Frac "6" and Frac "4" are opened using a sixth frac sleeve system 627. While seven fracturing locations are shown, any number of fracturing or treatment locations may be addressed using the system 10, which may include any number of devices 26, 27, 28. The sequence is repeated for any number of frac sleeve systems 27 in any order. Thus, a method is provided for employing the system 10 having a in a non-sequential fracturing order of operations without the need for intervention hydraulic controls from surface.

The systems 10, 100 realize the method of altering the sequence of the frac job or other stimulation. Production results using this method have exceeded offset wells with conventional sequential fracing, e.g., fracing in a consecutive sequence such as by fracing through sleeves 127, 227, 327 in that order. The exemplary embodiments described herein would allow for a change from a typical frac job employing the traditional "bottom up" approach (performed sequentially from a downhole location, such as a toe, to a more uphole location such as a heel) to an alternating stage process in which a first interval is stimulated near a toe, a second interval is stimulated closer to a heel, and a third interval is fractured, or otherwise treated, between the first and second intervals. This change in sequence changes the characteristics of pressurization of the formation during a pressure stimulation of a reservoir. Production results using this method typically exceed offset wells with conventional sequential fracing by connecting stress-relief fractures from previously frac'd flanking intervals. Conventional frac sleeve systems and methods render such a procedure very difficult and time consuming to conduct. The system disclosed herein employs frac sleeve systems 27 that are operable without ball seats or ball-shifted sleeves and thus enable maintenance of a full bore diameter through the fracing zones. Moreover the systems 10, 100 disclosed herein allow for conventional cementing since there are no ball seats to be fouled or protected from the cement. Additionally, the systems 10 and 100 described herein enable a method of conducting multi stage frac treatments in a well utilizing multiple sleeves 54, 56 that are self powered. Communication methods include spliceless communication by induction from a control line, communication by current flow from a control line extending past the downhole of the devices and using gap subs for telemetry, and generation of EM signals using a control line at the toe and gap subs. Frac treatments can be performed based on real time data from control line 50 or fiber optic cable 52. Better down hole control of operations without multiple splices or connections, or large power transmission needs is provided by the systems 10, 100.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A downhole communication and control system configured for use in a non-sequential order of treating a borehole, the system comprising:

a string having at least three ports including first, second, and third longitudinally spaced ports arranged sequentially in a downhole to uphole manner in the string;

at least three frac sleeve systems including first, second, and third frac sleeve systems arranged sequentially in a downhole to uphole manner in the string and arranged to open and close the first, second, and third ports, respectively, each frac sleeve system having self-powered, electronically triggered first and second sleeves;

communication signals to trigger the first, second, and third frac sleeve systems into moving the first and second sleeves to open and close the ports; and, a control line that is spliceless from downhole of the first frac sleeve system to uphole of the third frac sleeve system, the control line configured to deliver the communication signals to electronic triggers of the first, second, and third frac sleeve systems.

2. The system of claim 1, wherein the communication signals trigger the first, second, and third frac sleeve systems into moving to open and close the ports in a non-sequential order.

3. The system of claim 1, wherein the communication signals include:

a first communication signal, which triggers the first frac sleeve system to open the first port;

a second communication signal, which triggers the third frac sleeve system to open the third port;

a third communication signal, which triggers the first frac sleeve system to close the first port;

a fourth communication signal, which triggers the second frac sleeve system to open second port;

a fifth communication signal, which triggers the third frac sleeve system to close the third port; and, a sixth communication signal, which triggers the second frac sleeve system to close the second port, wherein the first through sixth communication signals are delivered sequentially.

4. The system of claim 1, further comprising a control unit programmed to provide the communication signals.

5. The system of claim 1, wherein the second sleeve in each of the frac sleeve systems includes a dissolvable insert substantially alignable with its respective port in a closed condition of the second sleeve.

6. The system of claim 1, further comprising a self-powered, electronically triggered packer system between each adjacent pair of frac sleeve systems.

7. The system of claim 1, further comprising a plurality of gap subs, each gap sub having an electrically open and an electrically closed position, each gap sub directing current to a respective frac sleeve system when in the electrically closed position.

8. The system of claim 1, wherein each frac sleeve system includes a substantially constant inner diameter and does not require a ball seat for operability.

9. A method of completing downhole operations in a non-sequential order using the system of claim 1, the method comprising:

triggering the first frac sleeve system to open the first port;

injecting a borehole with fluid through the first port;

triggering the third frac sleeve system to open the third port;

triggering the first frac sleeve system to close the first port, subsequent triggering the third frac sleeve system to open the third port;

injecting a borehole with fluid through the third port;

triggering the second frac sleeve system to open the second port;

triggering the third frac sleeve system to close the third port, subsequent triggering the second frac sleeve system to open the second port;

injecting a borehole with fluid through the second port; and, triggering the second frac sleeve system to close the second port.

10. The method of claim 9, further comprising dissolving a dissolvable insert in the second sleeve assembly of each frac sleeve system subsequent triggering the second frac sleeve system to close the second port.

11. The method of claim 9, wherein each first and second frac sleeve assembly in the first, second, and third frac sleeve systems includes first and second electronic triggers, and wherein triggering the first, second and third frac sleeve systems includes communicating the communication signals to each electronic trigger via an inductive coupler.

12. The method of claim 9, wherein each first and second frac sleeves in the first, second, and third frac sleeve systems is associated with an electronic trigger, and wherein triggering the first, second and third frac sleeve systems includes communicating the communication signals to each electronic trigger by directing current in a downhole direction via the spliceless control line on an exterior of the string to a location downhole of the first frac sleeve system and then in an uphole direction within the string.

13. The method of claim 12, wherein directing current in an uphole direction within the string includes passing current through at least one gap sub associated with each frac sleeve system when the at least one gap sub is in an electrically closed condition.

14. The method of claim 13, further comprising charging a battery or capacitor within each gap sub.

15. The method of claim 14, wherein producing through each port includes producing through a screened sleeve through each port.

16. The method of claim 9, further comprising reopening each closed port, subsequent completion of all injection treatments, and producing through each port.

17. A downhole communication and control system configured for use in a non-sequential order of treating a borehole, the system comprising:

a string having at least three ports including first, second, and third longitudinally spaced ports arranged sequentially in a downhole to uphole manner in the string;

at least three frac sleeve systems including first, second, and third frac sleeve systems arranged sequentially in a downhole to uphole manner in the string and arranged to open and close the first, second, and third ports, respectively, each frac sleeve system having self-powered, electronically triggered first and second sleeves, each frac sleeve system further including a body, first and second electronic triggers, first and second openings in the body openable to a first pressure, first and second enclosed chambers within the body having a second pressure less than that of the first pressure, and first and second piston members positioned between the first and second openings and the first and second chambers, respectively; and, communication signals to trigger the first, second, and third frac sleeve systems into moving the first and second sleeves to open and close the ports;

wherein the communication signals sent to the first and second electronic triggers expose the first and second piston members to the first pressure via the first and second openings and movement of the first and second piston members translates to movement of the first or second sleeves.

18. A downhole communication and control system configured for use in a non-sequential order of treating a borehole, the system comprising:

a string having at least three ports including first, second, and third longitudinally spaced ports arranged sequentially in a downhole to uphole manner in the string;

at least three frac sleeve systems including first, second, and third frac sleeve systems arranged sequentially in a downhole to uphole manner in the string and arranged to open and close the first, second, and third ports, respectively, each frac sleeve system having self-powered, electronically triggered first and second sleeves, each of the frac sleeve systems including first and second electronic triggers;

communication signals to trigger the first, second, and third frac sleeve systems into moving the first and second sleeves to open and close the ports;

a control line configured to deliver the communication signals to the first, second, and third frac sleeve systems; and a plurality of inductive couplers arranged along the string to deliver the communication signals from the control line to the electronic triggers.

* * * * *